US010049518B2

(12) United States Patent
Ichida

(10) Patent No.: US 10,049,518 B2
(45) Date of Patent: Aug. 14, 2018

(54) LOCKING SYSTEM

(71) Applicant: DENSO CORPORATION, Kariya, Aichi-pref. (JP)

(72) Inventor: Takashi Ichida, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/813,317

(22) Filed: Nov. 15, 2017

(65) Prior Publication Data

US 2018/0151011 A1 May 31, 2018

(30) Foreign Application Priority Data

Nov. 25, 2016 (JP) ..... 2016-228958

(51) Int. Cl.
*G07C 9/00* (2006.01)

(52) U.S. Cl.
CPC ..... *G07C 9/00563* (2013.01); *G07C 9/00071* (2013.01); *G07C 9/00309* (2013.01); *G07C 9/00912* (2013.01); *G07C 2009/00095* (2013.01); *G07C 2009/00539* (2013.01)

(58) Field of Classification Search
CPC ... G07C 9/00; G07C 9/00174; G07C 9/00563
See application file for complete search history.

(56) References Cited

U.S. PATENT DOCUMENTS 6,940,391 B1 * 9/2005 Ishikura ..... G07C 9/00309 340/5.7
9,875,591 B2 * 1/2018 Watters ..... G07C 9/00309
2015/0294518 A1 * 10/2015 Peplin ..... B60R 25/23 340/5.22
2016/0247339 A1 * 8/2016 Miller ..... B60R 25/24
2017/0103592 A1 * 4/2017 Buttolo ..... G07C 9/00015

FOREIGN PATENT DOCUMENTS

EP 957016 A1 11/1999
JP 2007-177476 A 7/2007

* cited by examiner

*Primary Examiner* — Carlos E Garcia
(74) *Attorney, Agent, or Firm* — Harness, Dickey & Pierce, P.L.C.

(57) ABSTRACT

A locking system includes a communication unit, a key including a first unique information, the key being capable of wirelessly connecting to the communication unit, a mobile device including a second unique information, the mobile device being capable of wirelessly connecting to the communication unit, a first verification unit that verifies the first unique information, a locking device configured to lock and unlock the space, a locking device controller that controls the locking device, a biometric information acquisition unit that acquires biometric information capable of identifying an individual, and a second verification unit that verifies the second unique information and the biometric information. After the first unique information and the second unique information are verified, the biometric information is verified, the space is unlocked when the acquired biometric information matches, and the space is locked or maintained in a locked state when the acquired biometric information does not match.

8 Claims, 3 Drawing Sheets

FIG. 3

DRIVER IDENTIFICATION

| | | INFO | INTERM | ACQUISITION | PRE/POST | IDENTIFICATION |
|---|---|---|---|---|---|---|
| MOBILE DEVICE | UNIQUE MOBILE INFO (PHONE NUMBER, IMIE, MAC, ETC.) OR CHARACTER STRING (USER ID AND PASSWORD, ETC.) | MOBILE | SMART KEY | VER. ECU | PRE | BODY ECU |
| | | MOBILE | → | Audio/Navi | POST | |
| | | MOBILE | → | DCM | POST | |
| | | MOBILE | CENTER | DCM | PRE | |
| CAMERA | FACE REC, IRIS, ETC. | FACE, IRIS | → | CAMERA | POST | |
| BIO SENSOR | PULSE, PRINTS, ETC. | PULSE, PRINTS | → | BIO SENSOR | POST | |

LOCKING SYSTEM

CROSS REFERENCE TO RELATED APPLICATION

The present application is based on Japanese Patent Application No. 2016-228958 filed on Nov. 25, 2016, disclosure of which is incorporated herein by reference.

TECHNICAL FIELD

The present disclosure relates to a locking system for privates spaces in a vehicle, such as a trunk or a glove compartment.

BACKGROUND

A plurality of vehicle keys may be associated with a single vehicle. For example, a main key may include all functions including starting the engine, while a sub key may be limited in functions such as being unable to unlock private compartments such as a trunk or a glove compartment.

Personal property, personal information, etc. may be stored in these private spaces such as the trunk or glove compartment. In other to protect these from theft, precautions are taken such as locking a trunk opening switch inside the glove compartment, or locking the glove compartment with a main key.

SUMMARY

However, performing these kind of actions during normal use of a vehicle is burdensome. Moreover, there are times when the vehicle key is temporarily given to a third party agent, such as during valet parking or using a car wash service. In this case, while it is preferable to give a sub key, it is troublesome for drivers to always carry a sub key, and so the main key may be given to the third party agent instead.

In view of the above, there is a desire to provide a locking system which appropriately controls the locking/unlocking of private spaces such as a trunk or a glove compartment.

In one aspect of the present disclosure, a locking system includes a communication unit capable with transmitting wireless data, a key including a first unique information, the key being capable of wirelessly connecting to the communication unit, a mobile device including a second unique information, the mobile device being capable of wirelessly connecting to the communication unit, a first verification unit that verifies the first unique information, a locking device configured to lock and unlock the space, a locking device controller that controls the locking device, a biometric information acquisition unit that acquires biometric information capable of identifying an individual, and a second verification unit that verifies the second unique information and the biometric information. After the first unique information and the second unique information are verified, the biometric information is verified, the space is unlocked when the acquired biometric information matches, and the space is locked or maintained in a locked state when the acquired biometric information does not match.

According to this aspect of the present disclosure, even if a legitimate driver gives the smart key to an agent driver for a task such as car washing or valet parking and the agent driver enters the vehicle, since the biometric information of the agent driver is not registered in advance, the space is locked or maintained in a locked state. For this reason, private spaces such as a trunk or a glove compartment may be appropriately locked/unlocked, and access to these private spaces by agent drivers may be limited. Accordingly, security may be improved without adversely affecting convenience.

BRIEF DESCRIPTION OF THE DRAWINGS

The disclosure, together with additional objectives, features and advantages thereof, will be best understood from the following description, the appended claims and the accompanying drawings, in which:

FIG. 3 is a chart showing driver identification details.

DETAILED DESCRIPTION

Hereinafter, a plurality of embodiments of the present disclosure will be described with reference to the figures. In the following discussion, a registered driver is defined as a person who legitimately operates a vehicle, such as a vehicle owner, and has registered biometric information in advance. In addition, an agent driver is defined as a person who temporarily receives a smart key from a registered driver and entrusted with specific duties, such as a car wash staff or a valet parking staff. In this case, the agent driver has not registered any biometric information in advance. Further, both of these persons, as well as simple passengers, may be individually or collectively referred to as drivers.

Figure 1:
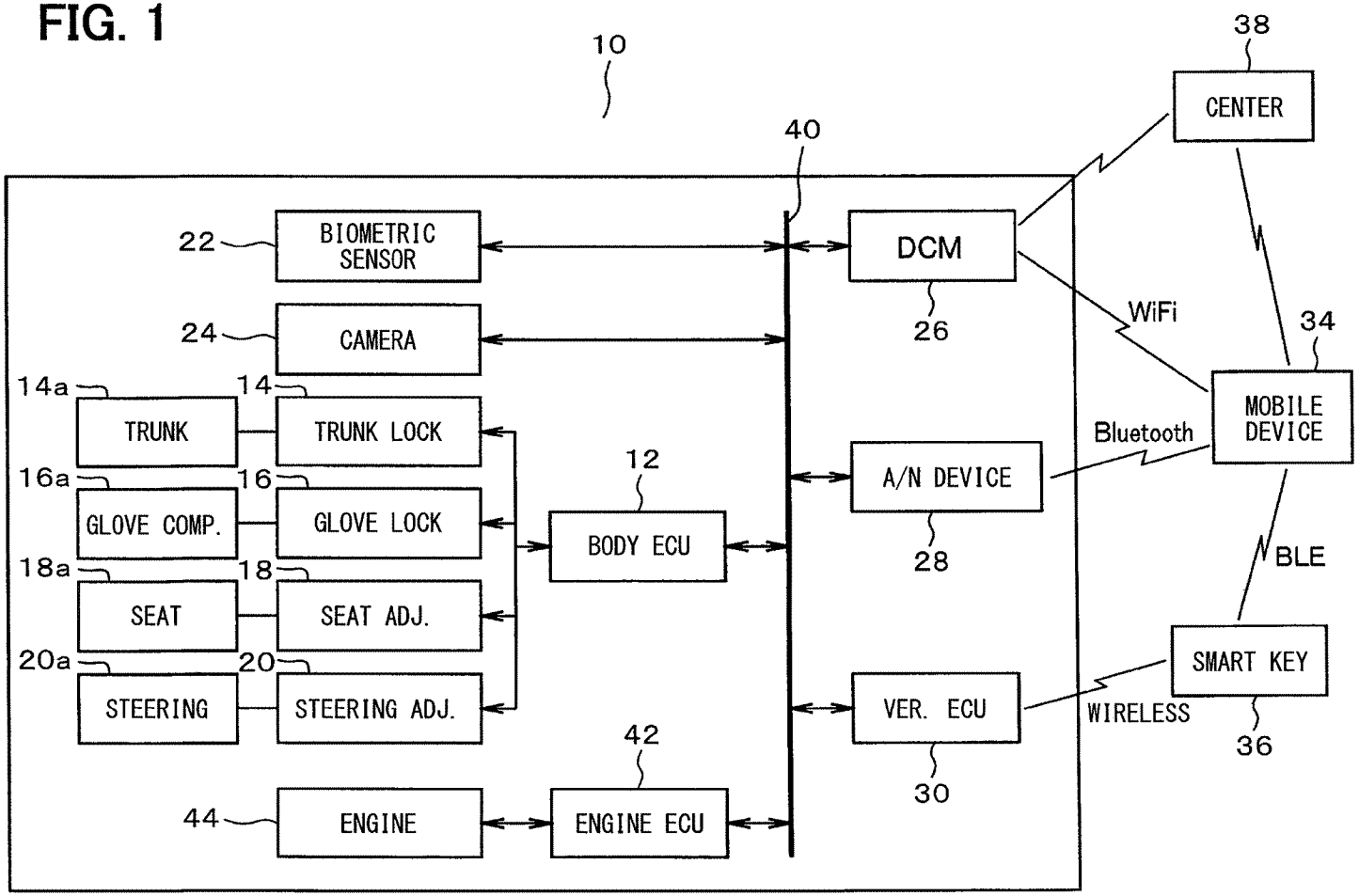
FIG. 1 is a system view of a locking system.

As shown in FIG. 1, a locking system 10 includes a body ECU (electronic control unit) 12, a biometric sensor 22, a camera 24, a DCM (data communication module) 26, an audio/navigation device 28, a verification ECU 30, and an engine ECU 42. These components are connected to a vehicle network 40, such as a vehicle LAN (local area network). In addition, the verification ECU 30 may be referred to as a first verification unit, and the body ECU 12 may be referred to as a second verification unit.

The DCM 26 and the audio/navigation device 28 include internal ECUs which are not illustrated. In addition, a mobile device 34, a smart key 36, and a center 38 are provided, and are capable of wirelessly connecting to the DCM 26, the audio/navigation device 28, and the verification ECU 30. In this regard, the DCM 26, the audio/navigation device 28, and the verification ECU 30 function as a communication unit capable of communicating wireless data.

The DCM 26 is configured to be wirelessly connectable to the center 38 through a wireless communication network. In turn, the center 38 is configured to be wirelessly connectable to the mobile device 34 through a wireless communication network. Here, a wireless communication network may be, for example, a cellular network, and the center 38 may be, for example, a cellular tower. Due to this, wireless data communication is possible between the DCM 26 and the mobile device 34. The mobile device 34 is configured to be wirelessly connectable to the audio/navigation device 28 and the smart key 36 through wireless communication protocols such as Bluetooth (registered trademark) or BLE (Bluetooth Low Energy) (registered trademark).

Generally, a plurality of smart keys 36 are provided for a vehicle. Unique key information is assigned to each smart key 36 to identify that particular key. Here, the unique key information may be referred to as a first unique information. In other words, since the unique key information is uniquely provided for each smart key 36, by using this information, it is possible to identify the smart key 36.

The verification ECU 30 wirelessly communicates with the smart key 36 to receive the unique key formation of the smart key 36, and identifies the smart key 36 through a comparison with unique key information registered in advance on the verification ECU 30. The smart key 36 may be a main key or a sub key. Here, a main key refers to a key with authority for all operations of a vehicle, while a sub key refers to a key which allows the vehicle to be driven but is limited in other operations.

Generally, specific smart keys 36 are given to specific drivers (such as within a family), and for each smart key 36, a variety of information are registered in the body ECU 12. This information may include, for example, seat position, steering wheel position, various settings for the audio/navigation device 28, or various settings for an air conditioner (not illustrated). When a driver holding a specific smart key 36 enters the vehicle, the following control processes are performed.

First, the body ECU 12 controls a seat positioning device 18 and a steering wheel positioning device 20 based on a stored seat position and a stored steering wheel position corresponding to the unique key information of this smart key 36, to automatically adjust the seat position and steering wheel position. Further, the body ECU 12 retrieves a variety of stored settings for the audio/navigation device 28 corresponding to the unique key information of the smart key 36 held by the driver. These settings include audio volume, navigation point registration, navigation history, etc. It should be noted that instead of registering these various setting information in advance, the body ECU 12 may simply use the various setting information from when the driver in possession of the smart key 36 last rode in the vehicle.

The body ECU 12, the verification ECU 30, the engine ECU 42, as well as the non-illustrated ECUs included in the DCM 26 and the audio/navigation device 28 are primarily comprised of a microcomputer having a CPU, memory units such as ROM or RAM, and I/O capabilities. The engine ECU 42 executes computer programs stored on ROM to perform processing corresponding to these computer programs. Specifically, based on engine operating conditions such as engine speed or engine load, the engine ECU 42 controls the operation of non-illustrated components such as a throttle valve, a fuel injection valve, or an ignition plug to control the driving condition of an engine 44.

The verification ECU 30 includes a communication unit (not illustrated), and is configured to be connectable with the smart key 36 through wireless communication. The verification ECU 30 executes computer programs, such as those stored on ROM, to perform various controls such as verifying the unique key information obtained from the smart key 36. Further, when the verification of the unique key information from the smart by 36 produces a noncompliant result, or when unique key information could not be obtained from the smart key 36, the verification ECU 30 executes anti-theft controls, such as controlling an immobilizer (not illustrated) to prevent the engine 44 from starting. Further, the body ECU 12, the DCM 26, and the verification ECU 30 are battery powered, and are capable of executing certain controls prior to a passenger of the vehicle turning on an accessory switch.

As shown in FIG. 3, the mobile device 34 includes various unique mobile information such as telephone number, IMEI (International Mobile Equipment Identify), or MAC (Media Access Control) address. The unique mobile information of the mobile device 34 may be referred to as a second unique information. The mobile unique information is uniquely provided for each mobile device 34, and may be used to identify the mobile device 34. Further, an arbitrary character string such as a user ID and password may be used as the unique mobile information.

FIG. 3 shows exemplary ways for the mobile device 34 to connect to the vehicle. If the mobile device 34 is at a remote location from the vehicle, the mobile device 34 may be connected to the DCM 26 through the center 38 by wireless communication.

Further, if the mobile device 34 is close to the vehicle and the accessory switch of the vehicle is turned on, the mobile device 34 may directly connect to the audio/navigation device 28 through wireless communication means such as Bluetooth (registered trademark), and may directly connect to the DCM 26 through WiFi (registered trademark) communication. This direct connection is shown as an arrow in FIG. 3.

If the mobile device 34 is connected to the center 38, the center 38 obtains the unique mobile information of the mobile device 34 and transmits this unique mobile information to the DCM 26. If the mobile device 34 is directly connected to the DCM 26 or the audio/navigation device 28 through wireless communication means, the mobile device 34 transmits unique mobile information to the DCM 26 or the audio/navigation device 28. In turn, the DCM 26 and the audio/navigation device 28 transmits the received unique mobile information to the body ECU 12. The body ECU 12 is able to identify the mobile device 34 by comparing the unique mobile information received from the DCM 26 or the audio/navigation device 28 with unique mobile information registered in advance. Accordingly, the body ECU 12 functions as a verification unit that verifies unique mobile information. Alternatively, the DCM 26 or the audio/navigation device 28 may perform the verification of the unique mobile information instead, and then simply send the result of the verification to the body ECU 12.

If the mobile device 34 is close to the smart key 36, the smart key 36 reads and stores the unique mobile information of the mobile device 34 using, for example, a BLE connection. Further, when the smart key 36 detects that the vehicle is nearby, the smart key 36 transmits the unique mobile information of the mobile device 34 to the verification ECU 30. The smart key 36 transmits the unique key information of this smart key 36 to the verification ECU 30, and the verification ECU 30 identifies the smart key 36 from the received unique key information, and then unlocks the door. Further, as mentioned above, the smart key 36 may transmit the unique mobile information of the mobile device 34 to the verification ECU 30, and in turn, the verification ECU 30 transmits the unique mobile information to the body ECU 12. The body ECU 12 then verifies the received unique mobile information with pre-registered unique mobile information.

As shown in FIG. 3, the transmission of the unique mobile information of the mobile device 34 is possible as long as communication is established between the mobile device 34 and any of the DCM 26, the audio/navigation device 28, the smart key 36, and the center 38. Since the DCM 26 is battery powered, wireless communication with the center 38 is possible prior to the vehicle accessories being turned on. Accordingly, a connection between the mobile device 34 and the DCM 26 through the center 38 is possible prior to the driver entering the vehicle and turning on the accessory switch. In this case, the DCM 26 allows verification of the unique mobile information of the mobile device 34 prior to the accessory switch being turned on.

The body ECU 12 is connected to a trunk locking device 14, a glove compartment locking device 16, the seat positioning device 18, and the steering wheel positioning device 20, and signals are transmitted and received therebetween. The trunk locking device 14 is disposed in a trunk 14*a*, the glove compartment locking device 16 is disposed in a glove compartment 16*a*, the seat positioning device 18 is disposed in a seat 18*a*, and the steering wheel positioning device 20 is disposed in a steering wheel 20*a*.

The body ECU 12, due to a CPU executing computer programs stored on ROM etc., performs various controls of the trunk locking device 14, the glove compartment locking device 16, the seat positioning device 18, and the steering wheel positioning device 20, thereby controlling the locking/unlocking of the trunk 14*a* and the glove compartment 16*a*, and controlling the positions of the seat 18*a* and the steering wheel 20*a*. In other words, the body ECU 12 functions as a locking device controller for the trunk locking device 14 and the glove compartment locking device 16, and functions as a positioning device controller for the seat positioning device 18 and the steering wheel positioning device 20. For a vehicle according to the present embodiment, the locking and unlocking of private spaces such as the trunk 14*a* and the glove compartment 16*a* are configured to be electronically controllable.

The biometric sensor 22 and the camera 24 function as biometric information acquisition units which obtain biometric information of passengers. Here, biometric information refers to biologically information for identifying individuals, i.e., individual identification information. Such individual identifying information includes face, iris pattern, pulse pattern, vein pattern, fingerprint, voice print, and other observable information obtained from the human body.

Among the biometric information, the face and iris pattern of the driver are obtained by analyzing images taken by the camera 24. Further, among the biometric information, the pulse pattern, vein pattern, fingerprint etc. are obtained by the biometric sensor 22. For pulse pattern, vein pattern, fingerprint, and voice print, a pulse acquisition device, a vein pattern acquisition device, a fingerprint acquisition device, a voice acquisition device etc. may be used as the biometric sensor 22. These biometric sensors 22 and the camera 24 may be collectively referred to as a biometric information acquisition unit. The biometric information obtained by the biometric information acquisition unit is transmitted to the body ECU 12 through the vehicle network 40. The pulse acquisition device, vein pattern acquisition device, fingerprint acquisition device, voice acquisition device etc. may be disposed within the vehicle, or may be disposed on, for example, on the steering wheel or a wearable device, in the audio/navigation device 28, etc.

In the body ECU 12, unique key information of smart keys 36, unique mobile information of mobile devices 34, as well as biometric information registered drivers such as face, iris pattern, pulse pattern, vein pattern, fingerprint, voice pattern etc. are registered in advance. The body ECU 12 verifies the transmitted unique key information, unique mobile information, and biometric information with the pre-registered unique key information, unique mobile information, and biometric information to identify this mobile device 34, smart key 36, and passenger.

FIG. 3 is an exemplary table that summarizes the above described configuration of the locking system 10. In particular, the INFO column depicts the type of information used for identification. For example, for the mobile device 34, the information being identified is the unique identity of the mobile device 34 itself. In the case of the mobile device 34, FIG. 3 shows four exemplary routes in which the identify of the mobile device 34 may be verified, consistent with the above explanations. The INTERM column lists any intermediary route the information travels through (e.g., the center 38). The ACQUISITION column lists the vehicle component used to acquire the information. The PRE/POST column indicates whether the information may be acquired prior to the driver boarding the vehicle. Finally, the IDENTIFICATION column indicates the vehicle component used to identify the driver based on the received information. As shown in FIG. 3, in the present embodiment, the body ECU 12 is responsible for identifying the driver.

Figure 2:
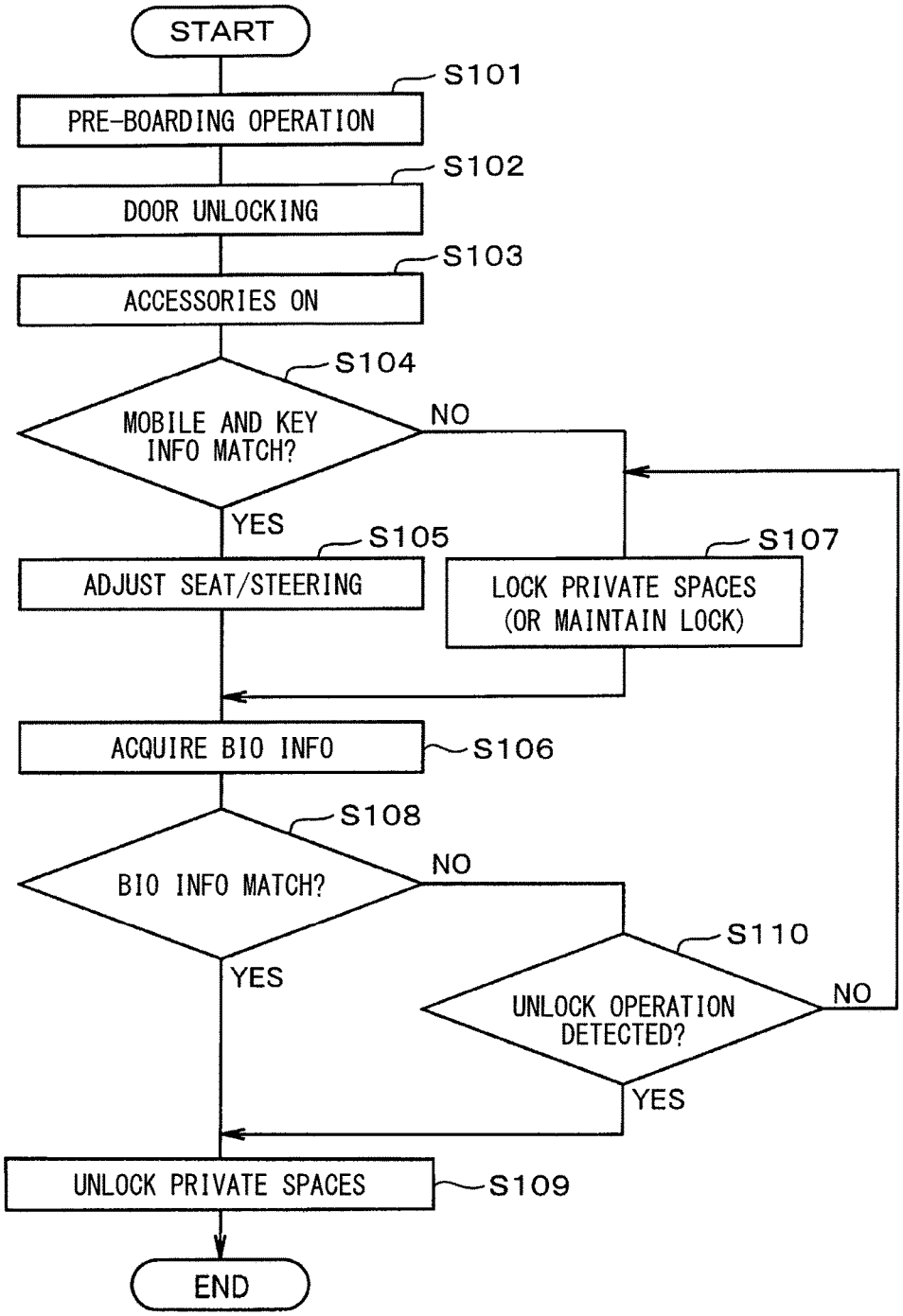
FIG. 2 is a flowchart of a control process.

Next, the flowchart of FIG. 2 will be used to explain the operation of the above described configuration. It should be noted that not all of the steps shown in FIG. 2 are required to practice the present embodiment, and several steps are shown for completeness. In an initial state, the trunk 14*a* and the glove compartment 16*a* are locked. As shown in FIG. 2, first, a pre-boarding remote operation is performed as a process prior to the driver entering the vehicle (S101). It should be noted that this step is optional. Specifically, this step is performed under the assumption that prior to entering the vehicle, the driver uses a pre-registered mobile device 34 to transmit remote operation information through the center 38 to the DCM 26. This remote operation information may include operations for starting the engine 44 with an engine starter (or engine starter system), setting an air conditioning temperature for an air conditioner (not illustrated), etc.

In this case, the DCM 26 receives both the remote operation information and the unique mobile information of the mobile device 34. The DCM 26 sends the unique mobile information of the mobile device 34 through the vehicle network 40 to the body ECU 12. A specialized application may be used for the mobile device 34 in order to facilitate sending and receiving the remote operation information with respect to the vehicle.

The body ECU 12 verifies the unique mobile information transmitted from the DCM 26 with pre-registered unique mobile information. As a result of the verification, if the transmitted unique mobile information matches the registered unique mobile information, a control permission signal is transmitted to the body ECU 12 or the engine ECU 42, and the body ECU 12 or the engine ECU 42 performs predetermined controls such as starting the engine 44 or setting air conditioning temperature. The above described verification of the unique mobile information may be performed by the engine ECU 42 as well.

Next, when the passenger holding the smart key 36 approaches the vehicle, the verification ECU 30 communicates with the smart key 36, and the unique key information of the smart key 36 is transmitted to the verification ECU 30. The verification ECU 30 verifies the transmitted unique key information with pre-registered unique key information. The verification ECU 30 functions as a verification unit that verifies unique key information. The verification ECU 30 performs a door unlocking process (S102) in which the door is unlocked when the unique key information matches, and the door is not unlocked when the unique key information does not match or cannot be detected. In other words, the door unlocking process is performed as long as the unique key information matches, without requiring verification of unique mobile information.

Since the verification ECU 30 has already verified the unique key information as part of the door unlocking process, the verification ECU 30 may directly transmit the verification result of the unique key information to the body ECU 12, or may transmit the unique key information itself to the body ECU 12 to allow the body ECU 12 to independently verify the unique key information. In the following discussion, it is assumed that the verification ECU 30 sends the unique key information to the body ECU 12.

If the body ECU 12 did not already receive the unique mobile information from the mobile device 34 at S101 (i.e., via the DCM 26), the body ECU 12 may receive the unique mobile information from the verification ECU at S102. Specifically, as described previously, the smart key 36 may obtain the unique mobile information of the mobile device 34 from the mobile device 34. In this case, the verification ECU 30 obtains both the unique mobile information and the unique key information from the smart key 36, and sends both information to the body ECU 12. Otherwise, if the smart key 36 has not obtained the unique mobile information from the mobile device 34, or if the body ECU 12 had already received the unique mobile information at 8101, the verification ECU 30 may send only the unique key information to the body ECU 12. At this time, private spaces such as the trunk 14*a* and the glove compartment 16*a* remain locked.

Next, the driver turns on the accessory switch (S103). Due to the accessory switch being turned on, the audio/navigation device 28, the biometric sensor 22, the camera 24, the trunk locking device 14, the glove compartment locking device 16, the seat positioning device 18, and the steering wheel positioning device 20 become operational. By this step, all components of the locking system 10 are operational, and the body ECU 12 is able to receive the unique mobile information from the mobile device 34 through any one of the routes illustrated in FIG. 3. In other words, if the body ECU 12 has not already received the unique mobile information at S101 or S102, then at this step, the mobile device 34 may directly connect to the audio/navigation device 28 or the DCM 26 to transmit the unique mobile information to the body ECU 12. As mentioned previously, the body ECU 12 may alternatively receive a verification result of the unique mobile information, such as from the DCM 26. In the following discussion, it is assumed that the body ECU 12 receives the unique mobile information itself.

Next, the body ECU 12, having received the unique mobile information and the unique key information, verifies the unique mobile information and the unique key information with pre-registered unique mobile information and unique key information (S104). When the result of the verification is that the pre-registered unique mobile information matches and that the verification result of the unique key information is matching (S104: YES), the body ECU 12 performs the following controls. In other words, the body ECU 12 reads seat position data, steering wheel position data, other vehicle environment, and various settings stored in advance on a storage device and which correspond to this unique key information. Then, the body ECU 12 controls the seat positioning device 18, the steering wheel positioning device 20, etc., to adjust the seat 18*a*, the steering wheel 20*a*, etc., to predetermined and pre-registered seat position and steering wheel position corresponding to the unique key information (S105). Then, the locking system 10 acquires biometric information (S106). 8106 will be described later.

When the result of the verification is that the pre-registered unique mobile information does not match, or that the verification result of the unique key information is not matching (S104: NO), the private spaces are locked, or maintained in a locked state if already locked (S107). Further, due to being locked at step S107, the private spaces are set such that it is not possible to unlocking the private spaces by authenticating the unique key information of the smart key 36, authenticating the unique mobile information during operating of the engine start system, or mechanical unlocking by the smart key 36. Next, biometric information is acquired (S106).

Biometric information is obtained by the biometric sensor 22, the camera 24, etc. as described previously (S106). As shown in FIG. 3, among the biometric information, the face and iris pattern of the driver are obtained by analyzing images taken by the camera 24. Further, among the biometric information, the pulse pattern, vein pattern, fingerprint, voice print etc. are obtained by the biometric sensor 22, which may be a pulse acquisition device, a vein patter acquisition device, a fingerprint acquisition device, a voice acquisition device etc. Further, the audio/navigation device 28 may be used as a voice acquisition device, i.e., maybe used as the biometric system 22.

The acquired biometric information is transmitted to the body ECU 12. The body ECU 12 verifies the received biometric information with pre-registered biometric information, and determines whether the acquired biometric information and the pre-registered biometric information match each other (S108). If the acquired biometric information matches the pre-registered biometric information (S108: YES), the body ECU 12 controls the trunk locking device 14 and the glove compartment locking device 16 to unlock private spaces such as the trunk 14*a* and the glove compartment 16*a* (S109), and the process ends.

If the acquired biometric information does not match the pre-registered biometric information (S108: NO), the body ECU 12 then determines whether an unlocking operation with respect to the private spaces is detected (S110). Here, detecting an unlocking operation is defined as receiving an unlock command which is reliably from a registered driver. For example, detecting an unlocking operation may include receiving an unlock command for the private spaces through the input of a user ID and password to the audio/navigation device 28, or using an unlocking application of the mobile device 34 to access the DCM 26 through the center 38 and then transmitting an unlocking command for the private spaces by for example entering a user ID and password, etc. In these examples, the user ID and password indicates that the unlock command is reliably from a registered driver.

When an unlocking operation is detected for the private spaces (S110: YES), the body ECU 12 unlocks the private spaces (S109), and the process ends. However, as shown in FIG. 2, when an unlocking operation is not detected for the private spaces, the process returns to S107, and the private spaces are locked or remain locked (S107). Then, biometric information acquisition (S106) is performed, and biometric information is verified again. If the newly acquired biometric information matches pre-registered biometric information (S108), the private spaces are unlocked (S109).

With the above configuration, for example if the registered drive temporarily gives the smart key 36 to an agent driver for certain tasks such as car washing or valet parking, and the agent driver enters the vehicle using the smart key 36 received from the registered driver, the following operation takes place.

First, when the agent driver in possession of the smart key 36 received from the registered driver approaches the vehicle, the verification ECU communicates with the smart key 36, and the unique key information of the smart key 36 is transmitted to the verification ECU 30. The verification ECU 30 verifies the transmitted unique key information with pre-registered unique key information. In this case, since the smart key 36 is the legitimate smart key 36 passed from the registered driver, the verification ECU 30 determines that the unique key information matches and unlocks the door (S102). The verification result of the verification ECU 30 (in this case, the verification result is a match) is transmitted to the body ECU 12.

Next, the body ECU 12 performs a verification of unique mobile information, but the agent driver does not have the mobile device 34 with unique mobile information which is pre-registered in the body ECU 12. In particular, the mobile device of the agent driver is not even setup for communication with the locking system 10, and so the locking system 10 is not able to obtain unique mobile information from the mobile device 34. Accordingly, the body ECU 12 determines that the unique mobile information does not match. This operation is the same as if the agent driver does not have a mobile device. Accordingly, while the unique key information matches, the unique mobile information does not match (S104: NO), and the locking system 10 locks the private spaces (S107).

Next, after the body ECU 12 performs the positioning adjustment of the seat 18*a* and the steering wheel 20*a* (S105), the locking system 10 acquires biometric information (S106), but since the biometric information of the agent driver has not been registered in advance, the biometric information does not match (S108: NO). Further, generally the registered driver would not perform an unlocking operation at this time, and so no unlocking operation would be detected (S110: NO), and thus the locking system 10 maintains the private spaces in a locked state (S107).

Due to the above control process, even if the registered driver gives the smart key 36 to an agent driver for tasks such as car washing or valet parking, private spaces such as the trunk 14*a* and the glove compartment 16*a* reliably remain locked. As a result, it is possible to prevent theft etc. of personal items or private information stored in these private spaces, and therefore the security of the vehicle may be improved. Further, in this case, the smart key 36 is a legitimate key, so the agent driver is capable to starting the engine 44 and driving the vehicle. Therefore, the agent driver is still capable of performing tasks such as car wash or valet parking. Accordingly, according to the locking system 10 of the present embodiment, the agent driver is able to operate the vehicle, while access to the private spaces may be regulated. In other words, security may be improved without adversely affecting convenience.

Further, when a registered driver, i.e., a person who legitimately operates a vehicle, such as a vehicle owner, is riding in the vehicle, the pre-registered unique key information of the smart key 36, the pre-registered unique mobile information of the mobile device 34, and the pre-registered biometric information all match the registered unique key information, unique mobile information, and biometric information. Accordingly, the private spaces are normally unlocked, and security may be improved without adversely affecting convenience.

Further, for example, if a registered driver is wearing sunglasses or other facial coverings when entering the vehicle and among the biometric information, the face recognition by the camera 24 does not match (S108: NO), the private spaces remain locked. However, the biometric sensor 22 acquires other biometric information, and if these information match (S108: YES), the private spaces are normally unlocked (S109). Further, the camera 24 continuously monitors the vehicle interior, so for example if the driver removes their sunglasses after entering the vehicle, facial information may be readily captured (S108 and S110 are repeated in case of no match). Accordingly, even if other biometric information cannot be captured, facial recognition is possible as long as sunglasses etc. are removed, and there is no burden on the user. For this reason, security may be improved without adversely affecting convenience.

In addition, even without matching biometric information, as long as the aforementioned unlocking operations (S110) may be performed to unlock the private spaces. Accordingly, the private spaces may be unlocked in case of malfunctions in the biometric information check, or in case of emergencies, etc. For this reason, security may be improved without adversely affecting convenience.

Other Embodiments

The present disclosure is not limited to the embodiments of the aforementioned descriptions or figures, and a variety of modifications which do not depart from the gist of the present disclosure are contemplated.

The body ECU 12 is described as performing the verification of biometric information, but this may be performed by other devices such as the verification ECU 30, an ECU included in the audio/navigation device 28, etc., or a combination of these ECUs.

In addition, the above embodiment is described with respect to a plurality of interlinked ECUs and other components such as the DCM 26, in consideration of how actual vehicle networks are typically implemented in practice. However, the scope of the present disclosure is not intended to be limited to this configuration. Instead, some or all of the components of the locking system 10 as shown in FIG. 1 may be integrated. For example, a single integrated ECU may perform the functions of two or more among the group of the engine ECU 42, the verification ECU 30, the body ECU 12, and the DCM 26.

The trunk 14*a* and the glove compartment 16*a* are described as examples of private spaces, but these examples are not intended to be limiting. The present disclosure is applicable to a variety of spaces for which there is an expectation of security, including separately provided storage boxes.

Face, iris pattern, pulse pattern, vein pattern, fingerprint, voice print are provided as examples of biometric information, but these examples are not intended to be limiting. Other kinds of observable information which may be acquired from the human body, such as body weight, body temperature, blood pressure, pulse level, body shape, etc. of the passenger may be used as additional biometric information to improve the accuracy of identifying the passenger.

Further, the above embodiment is described where a single kind of matching biometric information results in the private spaces being unlocked, but this is not intended to be limiting. For example, unlocking may be limited to when a plurality of kinds of biometric information, such as both face and fingerprint, match. In this regard, the security level of the locking system 10 may be improved.

The present disclosure is not intended to be limited to the embodiments and structures described herein, and a variety of modification and equivalencies are covered. In addition, a combination of the embodiments, partially or otherwise, are contemplated by the present disclosure.

The invention claimed is:

1. A locking system for controlling a locking state of a lockable space based on verification with pre-registered information, comprising:

a communication unit capable with transmitting wireless data;

a key including a first unique information, the key being capable of wirelessly connecting to the communication unit;

a mobile device including a second unique information, the mobile device being capable of wirelessly connecting to the communication unit;

a first verification unit that verifies the first unique information with a first pre-registered unique information;

a locking device configured to lock and unlock the space;

a locking device controller that controls the locking device;

a biometric information acquisition unit that acquires biometric information capable of identifying an individual; and a second verification unit that verifies the second unique information with a second pre-registered unique information, and that verifies the acquired biometric information with pre-registered biometric information, wherein after the first unique information is verified with the first pre-registered unique information and after the second unique information is verified with the second pre-registered information, the acquired biometric information is verified with the pre-registered biometric information and as a result the space is unlocked when the acquired biometric information matches, and the space is locked or maintained in a locked state when the acquired biometric information does not match.

2. The locking system of claim 1, wherein if either the result of the verification of the first unique information with the first pre-registered unique information or the result of the verification of the second unique information with the second pre-registered information does not match, the space is locked or maintained in a locked state.

3. The locking system of claim 1, wherein the biometric information includes one or more of face, iris pattern, pulse pattern, vein pattern, fingerprint, or voice print.

4. The locking system of claim 1, wherein the biometric information acquisition unit includes one or more of a biometric sensor or a camera.

5. The locking system of claim 4, wherein the biometric system is one of more of a pulse acquisition device, a vein pattern acquisition device, a fingerprint acquisition device or a voice acquisition device.

6. The locking system of claim 1, wherein the locking and unlocking of the space is configured to be electronically controlled.

7. The locking system of claim 1, wherein the space includes one or more of a trunk or a glove compartment.

8. A locking system, comprising:

an electronic control unit (ECU) mounted in a vehicle, the ECU being configured to lock and unlock a door of the vehicle and a space in the vehicle;

a biometric sensor mounted in the vehicle, the biometric sensor being configured to acquire biometric information of a passenger in the vehicle;

a key configured to transmit unique key information to the ECU; and the ECU is programmed to:

verify the unique key information by comparing the unique key information with pre-registered key information and unlock the door if the unique key information matches the pre-registered key information, and after verifying the unique key information, verify the acquired biometric information by comparing the acquired biometric information with pre-registered biometric information, and based on this comparison:

unlock the space if the acquired biometric information matches the pre-registered biometric information, and lock the space if the acquired biometric information does not match the pre-registered biometric information even if the unique key information matched the pre-registered key information.

* * * * *